United States Patent [19]

Vanjukov et al.

[11] 4,252,560

[45] Feb. 24, 1981

[54] PYROMETALLURGICAL METHOD FOR PROCESSING HEAVY NONFERROUS METAL RAW MATERIALS

[76] Inventors: Andrei V. Vanjukov, ulitsa Miklukho-Maklaya, 65, kv. 4, Moscow; Valery V. Mechev, prospekt Lenina, 44a, kv. 49, Norilsk; Valentin P. Bystrov, Schelkovsky proezd, 3, korpus 3, kv. 43, Moscow; Evgeny I. Ezhov, Grazhdansky prospekt, 11, Leningrad; Mikhail G. Vasiliev, prospekt Lenina, 31, kv. 89, Norilsk; Vladimir Y. Zaitsev, ulitsa Lobachevskogo, 6, kv. 34; Vladimir A. Romenets, Lomonosovsky prospekt, 33, korpus 2, kv. 87, both of Moscow; Vladimir V. Ivanov, ulitsa Leningradskaya, 22, kv. 26; Sergei Y. Golik, prospekt Lenina, 13, kv. 87, both of Norilsk; Evgeny S. Grin-Gnatovsky, 2 Schukinsky proezd, 5, kv. 1, Moscow; Alexandr V. Grechko, Vesennaya ulitsa, 4, kv. 42; Ivan V. Savin, ulitsa Vesennaya, 4, kv. 56, both of Ryazan; Sultanbek M. Kozhakhmetov, ulitsa Shevchenko, 32, kv. 16; Veniamin B. Meierovich, ulitsa Auezova, 175b, kv. 29, both of Alma-Ata; Vladimir D. Nagibin, ulitsa Pushkinskaya, 7/5, kv. 6, Moscow; Nariman A. Ramazanov, ulitsa Seifullina, 452/3, kv. 25; Almas B. Umarov, Mikroraion Koktem - 1, dom 37, kv. 51, both of Alma-Ata; Valentin E. Ziberov, ulitsa Voronezhskaya, 38/43, kv. 309, Moscow; Askar M. Kunaev, ulitsa Vinogradova, 49/130, kv. 23; Sauk T. Takezhanov, ulitsa Shevchenko, 44, kv. 3, both of Alma-Ata; Petr A. Alexandrov, ulitsa Pushkinskaya, 2, Balkhash Dzhezkazganskoi oblasti; Boris I. Kolesnikov, prospekt Lenina, 11, kv. 24; Dzhonson T. Khagazheev, ulitsa Entuziastov, 53, kv. 93, both of Norilsk, all of U.S.S.R.

[21] Appl. No.: 962,603

[22] Filed: Nov. 21, 1978

[51] Int. Cl.[3] ..... C22B 15/04

[52] U.S. Cl. ..... 75/21; 75/73; 75/82; 75/88

[58] Field of Search ..... 75/73, 74, 92, 75, 21, 75/23, 82, 77, 88, 86, 87

[56] References Cited

U.S. PATENT DOCUMENTS

| | | | |
|---|---|---|---|
| 3,326,672 | 6/1967 | Worner | 75/73 |
| 3,832,163 | 8/1974 | Themelis et al. | 75/74 |
| 3,892,559 | 7/1975 | Quarm | 75/72 |

*Primary Examiner*—M. J. Andrews

*Attorney, Agent, or Firm*—Fleit & Jacobson

[57] ABSTRACT

A method for processing heavy nonferrous metal raw materials by heating and melting said raw materials in a molten slag with the formation of a heterogeneous melt consisting of a sulfide and an oxide phases. The melt is bubbled oxidized by injecting a gas containing not less than 35% oxygen at an intensity of about 200 to about 2000 $m^3$ STP/h per square meter of horizontal section of the melt, with the effect that the melt is divided into a top bubbled part and a bottom calm part comprising a slag layer, a mattelayer and/or a crude metal layer, each of which is tapped separately. A furnace for putting said method into effect is a shaft terminating in its bottom part by a hearth and having devices for tapping smelting products, whereas the top part is provided with orifices for feeding a charge and removing gaseous smelting products. The furnace has cooled side tuyeres set at a level dividing the shaft into two vertical parts. The device for tapping slag from the bottom part of the slag layer is formed with a recipient communicating with the internal cavity of the shaft by means of a duct arranged below the tuyere level, but above the level of the matte inside the shaft. Said technological sequence of operations and the furnace design provide a possibility of separating polymetallic raw materials by a single-stage process into smelting products and denuded slag. It is most effective to employ the present invention for processing high-sulfur copper, nickel, copper-nickel and copper-zinc raw materials.

13 Claims, 4 Drawing Figures

PYROMETALLURGICAL METHOD FOR PROCESSING HEAVY NONFERROUS METAL RAW MATERIALS

BACKGROUND OF THE INVENTION

1. Field of the Invention

The invention relates to nonferrous metallurgy, and more particularly, to pyrometallurgical methods and furnaces for processing heavy nonferrous metal raw materials.

The present invention is particularly suitable for extracting copper, nickel, lead, zinc from monometallic and polymetallic raw materials.

2. Description of the Prior Art

In a pyrometallurgical processing of heavy nonferrous metal raw materials, the oxidation of said materials gives off a substantial amount of heat, which, when using oxygen-enriched air or pure oxygen, is sufficient to cover the requirements of the process. However, the oxidation of a molten sulfide, e.g., a matte, by a gas containing more than 30% oxygen leads to a considerable local overheating of the zone where the gas is injected into the melt and results in damage to said section of a metallurgical apparatus.

At present, there are being developed and introduced industrially a number of methods for processing heavy nonferrous metal sulfide raw materials involving a maximum utilization of the heat from the oxidation of said sulfides.

By their main characteristics, said methods may be classed with three trends having some variations.

One of said technological trends in the development of sulfide raw materials processing consists in injecting heavy nonferrous metal raw materials in the form of a dry flotation concentrate by means of oxygen or a gas enriched with oxygen into the gas space of a smelting unit and oxidizing said materials without direct contact with walls of said unit. In this case, there evolves a great amount of heat and the off gases are high in $SO_2$.

However, as each particle of the raw materials is oxidized individually in a jet of oxygen-bearing gas, a high proportion of nonferrous metals turns to oxides and dissolves in slag. In subsequent processing of said slag, the dissolved nonferrous metals precipitate therefrom as very fine inclusions which are very difficult to separate from the slag, this greatly lowering the effectiveness of the process as a whole.

Another trend in the processing of sulfide raw materials with the aid of oxygen-bearing gas of high oxygen content is to supply said gas through top tuyeres upon the surface of the melt. This results in an increased service life of the smelting unit, but requires a complicated tuyere design, a high-pressure gas for stirring the melt, involves a rapid failure of tuyere tips. In addition, the slag, being a lighter product, floats on the surface of the melt and shields the sulfides and is the first to be overoxidized, said inconvenience leading to greater losses of nonferrous metals with the slag.

Still another trend consists in injecting an oxygen-bearing gas through side tuyeres into a layer of molten matte similarly to a known process, such as converting, and feeding a charge into a stirred body of melt. However, as already noted, in areas where a gas with more than 30% is injected, the melt and the enclosing walls of the smelting unit tend to overheat with resultant damage to said walls. Therefore, use is made only of air enriched with oxygen to less than 30%. This impairs thermal conditions, lessens the content of $SO_2$ in the off gases and lowers overall efficiency. The injection of an oxygen-bearing gas into matte also increases the oxidation of nonferrous metals and contributes to their greater losses with the slag.

There are various combinations of the above technological variants, but their effect as regards the improvement in the potentialities of the processes is slight.

The closest to the present invention is the continuous smelting and converting of copper mattes (see U.S. Pat. No. 3,832,163, Cl.75-74 H/c22b 15/00).

The process is effected in a reactor divided into three zones along a horizontal axis: a smelting and converting zone, a copper accumulation zone and a slagging zone. A copper concentrate is mixed with a flux and a concentrate from slag-treatment, the resultant mixture is pelletized, and the pellets are continuously or intermittently charged into a reactor upon the surface of a melt. At the same time, air or air enriched with oxygen is injected into the lower part of the matte layer at a velocity ensuring an intensive stirring of the melt in said zone and a continuous and effective oxidation of iron and sulfur contained in the concentrates. The temperature in the smelting and converting zone is maintained at a value exceeding the melting points of metal copper, of matte and of slag, with the effect all of the phases in the reactor are in a molten state. The reduced metal copper is collected in its accumulation zone, whence it is tapped at required intervals. Molten slag accumulates in the slagging zone, whence it is also intermittently or continuously removed. Air and a reducing gas are injected into the slagging zone. A solid reducing agent or a portion of the copper concentrate of the charge may also be injected into the slag. The slag discharged from the reactor is slowly cooled, ground, flotated, and the flotation concentrated is mixed with the starting copper concentrate and flux prior to pelletizing.

As, in the above smelting method, an oxygen-bearing gas is injected into the matte layer, the gas is but little enriched with oxygen. This results in considerable losses of heat with the off gases and necessitates the burning of a large amount of carbonaceous fuel, or as much as $3.95.10^6$ kcal/ton of dry concentrate. In addition, the injection of the whole of the oxygen-bearing gas into the body of matte leads to a considerable increase in the amount of oxidized nonferrous metals, the oxides passing to slag, a phenomenon well known from converting practice. And although the method under consideration provides for special procedures for reducing the slag prior to tis discharge, the content of copper in the slag is not lower than 8 or 10%. Thus, the direct recovery of copper to crude metal is a mere 50–60%, and the resultant slag requires flotation denudation. Because of the lack of conditions for an effective separation of matte from slag and because of the stirring of slag and of matte in an oxidizing atmosphere, a direct recovery of about 50% of copper necessitates in said method the holding of the melt in the furnace for a long time, this bringing down the specific efficiency of the unit per square meter of horizontal section of the furnace to 10 $t/m^2.24$ h or to 0.42 $t/m^2.h$.

Thus, no conditions are provided in the above method for an effective processing of sulfide materials with the use of oxygen-enriched gas.

Among the known apparatus for processing heavy nonferrous metal raw materials, the closest to the present invention is a modified fuming furnace (see U.S. Pat.

No. 3,892,559 of July 1, 1975, U.S.Cl. 75/21) which is essentially a rectangular shaft composed totally of steel water-cooled water jackets. Side tuyeres for injecting a gas into the melt are placed near the hearth, this resulting practically in an oxygen-bearing gas being injected into the matte layer. The devices employed to feed the charge into the melt are modified tuyeres provided with additional sleeves, one each. Slag, matte and crude metal are discharged at required intervals through a taphole without being separated inside the furnace shaft, whereas the gaseous smelting products are exhausted with the aid of a flue arranged in the top part of the shaft.

The above apparatus fails to provide an effective separation of the slag from the matte or crude metal inside the furnace and their individual discharge because of a low arrangement of the tuyeres and the stirring of the whole of the molten mass inside the furnace shaft. Steel water jackets in the tuyere zone and the stirring of the melt with a high matte content make it impossible to raise the efficiency of the smelting unit through the use of a blast with a high oxygen content for fear of melting off the slag lining the water jackets and damaging the walls thereof in case of inadequate heat removal. A substantial disadvantage of said apparatus is a lack of continuous separate discharges of slag and matte.

All this results in a slag with a high residual content of nonferrous metals and, therefore, in a poor economic performance of the process.

SUMMARY OF THE INVENTION

It is therefore an object of the present invention to provide a high recovery of useful components of raw materials into products rich in said useful components at a high efficiency and at a least consumption of carbonaceous fuel in a pyrometallurgical processing of heavy nonferrous metal raw materials.

Another object of the present invention is to provide a pyrometallurgical method and a furnace for processing heavy nonferrous metal raw materials combining high rates of chemical reactions with a rapid and complete separation of smelting products by bubbling a heterogeneous melt with a gas rich in oxygen and separating the body of the melt into different layers.

The above and other objects are attained in a pyrometallurgical method for processing heavy nonferrous metal raw materials by smelting in a molten medium consisting in that the heavy nonferrous metal raw materials are heated and melted in molten slag with the formation of a heterogeneous melt composed of a sulfide and an oxide phases bubbled by an oxygen-bearing gas interacting therewith, with the effect that smelting products are formed and subsequently discharged, according to the invention, the melt is bubbled and oxidized by injecting thereinto a gas containing not less than 35% oxygen at an intensity of 200 to 2000 $m^3$ STP/h per square meter of horizontal section of the of the melt, with the effect that the melt is divided into a top bubbled part and a bottom calm part consisting of a slag layer, a matte layer and/or a crude metal layer, each smelting product being discharged separately from the lower part of the corresponding layer.

This makes it possible to effect, at high rates, the various necessary chemical processes, such as the preferable oxidation of iron sulfides and the sulfidizing of oxygen compounds of nonferrous metals, to obtain a high-grade matte and a slag low in nonferrous metals and to effectively separate the slag from the matte and/or the crude metal.

To ensure adequate heating conditions, a carbonaceous fuel, such as natural gas, fuel oil, pulverized coal, lump coal, lump coal, coke and others, may be injected in to the top bubbled part of the heterogeneous melt.

It is advantageous to continuously oxidize the matte separated from the heterogeneous melt by an oxygen-bearing gas to crude metal and to mix the resultant off gases with those from the smelting process for effectively removing and utilizing sulfur.

This makes it possible to convert the matte without raising the losses of nonferrous metal with the slag, and so sharply improve the direct recovery of the nonferrous metals to the crude metal without having to additionally denude the slag.

Slag from the oxidation of the matte may be returned in solid or liquid form to the top bubbled part of the heterogeneous melt for extraction of the useful components.

When zinc is present in the starting raw materials, it is useful to separate the slag from the heterogeneous melt and to bubble it by a gas under reducing conditions for driving off volatile components and effecting a deep denudation of the slag.

This makes it possible to collect readily volatile components as sublimates together with a small amount of entrained dust and so sharply enhance the effectiveness of the subsequent treatment of said dust. In addition, the reducing treatment of the slag may result in the reduction of nonvolatile nonferrous metals with a small amount of iron of the slag, said metals being collected in a bottom phase and discharged from the smelting unit either independently or together with a primary bottom phase.

The reducing conditions are provided in a manner to suit the specific objects of the processes involved, this enhancing the rates of the reduction processes and providing a deeper denudation of the slags.

A slag may be bubbled by a gas under reducing conditions with the addition of a sulfide extracting phase, e.g., pyrite, pyrrhotite, sulfide ore and other materials in the course of reducing treatment, this contributing to a speedier extraction of the non-volatile nonferrous metals from slag as sulfides, a deeper denudation of slag and an effective separation of the slag from the matte in a least possible time. This aim is also attained in a furnace for carrying out the pyrometallurgical method for processing heavy nonferrous metal raw materials, consisting of a shaft having in its middle part a water-jacketed section with side tuyeres for injecting a gas into the melt and terminating in its bottom part in a hearth provided with devices for tapping the slag, the matte and the crude metal, and having in the top part of the shaft an orifice for feeding the charge and a flue for exhausting gaseous smelting products, according to the invention, is provided with cooled side tuyeres placed at a level dividing the furnace shaft into two vertical parts with the heights of the top and of the bottom parts being in a ratio of 2-to-1 to 10-to-1, a device for tapping slag from the bottom part of the slaf layer being formed with a recipient communicating with the internal cavity of the shaft by means of a duct arranged below the level of the tuyeres, but above the level of the matte inside the shaft, with the effect that the level of the slag in the recipient determines the level of the melt inside the shaft.

This makes it possible to effect the smelting process continuously under stationary conditions, while retaining constant the height of the bubbled heterogeneous melt layer.

The furnace may incorporate a device for tapping the matte and/or the crude metal formed with a recipient communicating with the internal cavity of the shaft by means of a duct located below the level of the matte or the crude metal in the cavity, the quantity of the matte inside the furnace remaining constant throughout the process of smelting.

It is useful to provide the cavities for tapping the various phases with a heating device, this avoiding the formation of melt crusts on stopping and starting of the smelting process.

The side tuyeres may be provided with sleeves for feeding therethrough a charge and/or a fuel, this making possible the processing of finely divided charges.

The recipients for tapping matte may be equipped with devices for feeding an oxygen-bearing gas for oxidizing the matte to the crude metal and with a port, arranged at the matte level, for running off the slag.

All this makes possible a continuous converting of the matte resulting from the smelting of the raw materials.

It is useful to provide the furnace with a device for tapping the crude metal obtained through the oxidation of the matte, said device being a recipient communicating with the internal cavity of the recipient for tapping the matte via a duct arranged below the level of the crude metal, with the effect that the level of the crude metal in the recipient will determine the level of the crude metal inside the shaft and the recipient for tapping the matte, this realizing a direct manufacture of the crude metal in a single processing stage.

To organize a local reducing treatment of the slag, a vertical partition may be installed in the furnace and arranged inside the shaft in a manner to divide the internal cavity thereof up to the matte layer into two communicating chambers, a first chamber and a second chamber, a charge being smelted and smelting products being, formed in the first chamber and the slag being reduced and denuded in the second chamber, both chambers having individual devices for exhausting gaseous smelting products.

The service life of the vertical partition may be enhanced by making it of a cooled design in the zone where it is washed by the melt.

It is good practice to install the additional vertical cooled partition in the second chamber in a manner to situate one of its ends in the matte layer, and the other, above the tuyeres.

This makes it possible to provide a directed flow of slag from the first chamber to the second chamber.

The chamber for reducing and denuding slag in the top part of the shaft may be equipped with an orifice for charging a reducing agent and/or sulfide materials.

The furnace may also be provided with a device for injecting inside the shaft an oxygen-bearing gas or oxygen for the to ensure an effective oxidation of all the components of gaseous products resulting from the smelting process, said device being mounted in the top part of the jacketed section of the shaft substantially at mid-height of the shaft.

BRIEF DESCRIPTION OF THE DRAWINGS

These and other objects and features of the invention become readily apparent from one embodiment thereof which will now be described by way of example with reference to the accompanying drawings, in which.

DESCRIPTION OF THE PREFERRED EMBODIMENTS

The present invention consists essentially in the following.

Figure 2:
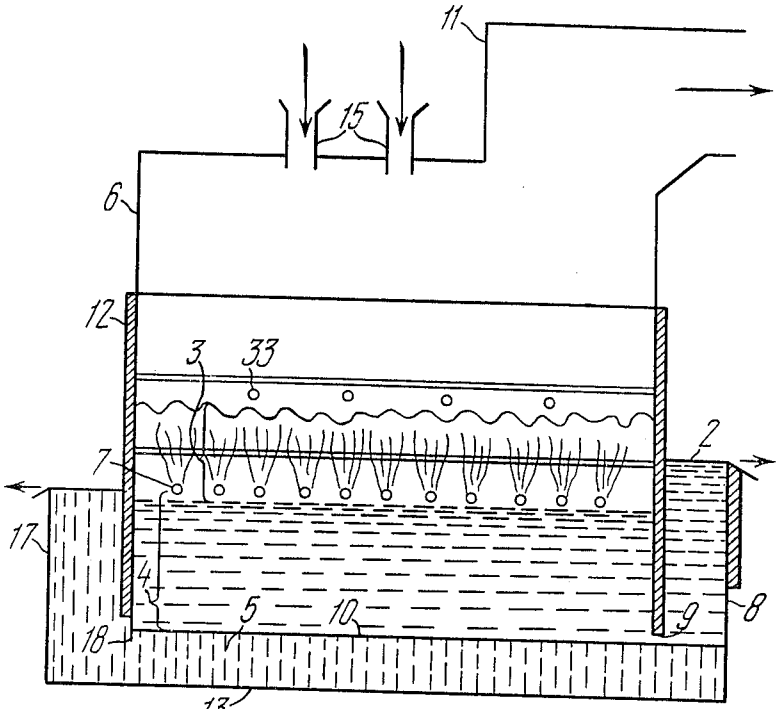
FIG. 2 is a schematic longitudinal section of the furnace without a reducing first chamber, according to the invention.
Figure 1:
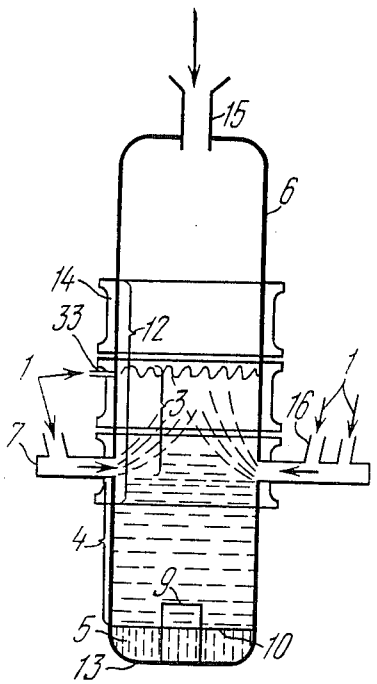
FIG. 1 is a schematic cross section of a furnace for a pyrometallurgical method for processing heavy nonferrous metal raw materials, according to the invention.
Figure 3:
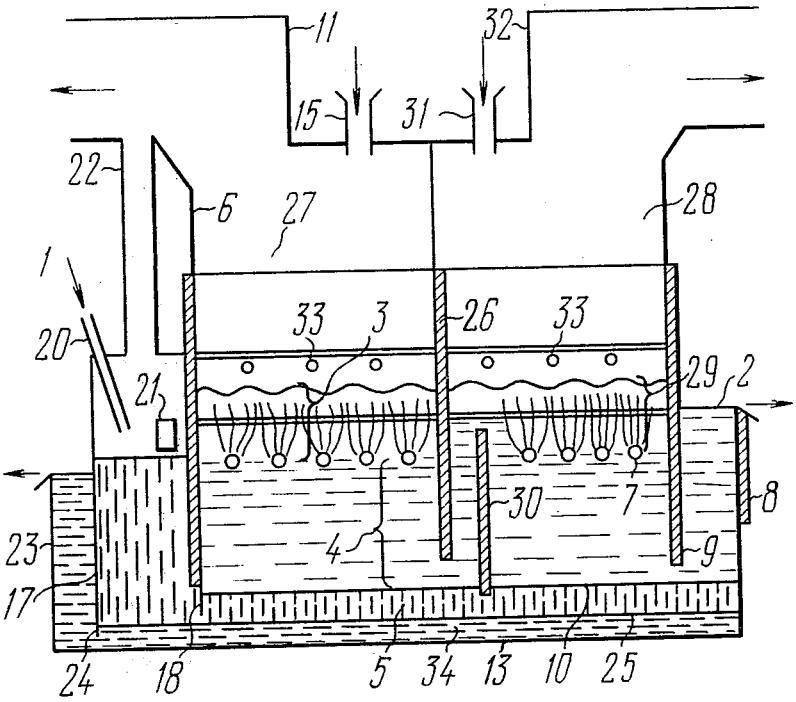
FIG. 3 is a schematic longitudinal section of a furnace with the reducing chamber and a recipient 17 employed for converting matte, according to the invention.

An oxygen-bearing gas 1 (FIG. 1) with more than 35% oxygen is injected at a pressure of about 1 atm in amounts of 200 to 2000 $m^3$ STP/h per square meter of horizontal cross section of a molten medium at a level approximately 300 to 400 mm below a top level 2 (FIG. 3) of the calm body of a molten slag of a total depth of 2.0 to 2.5 m. The oxygen-bearing gas 1 (FIG. 1) bubbles the top part of the melt, vigorously stirs it and creates a gas-saturated layer of a heterogeneous melt 3 1.5 to 2.5 m high consisting mainly of the slag with about 10 to 30% by volume of sulfide inclusions and comprising, if need be, coal and coke. The oxygen-bearing gas 1 (FIG. 1) interacts, as it bubbles through the layer of the heterogeneous melt 3, in the first place, with sulfides and or coal, to generate uniformly throughout the top layer the heat necessary for smelting a charge and heating a resultant melt. Owing to intensive stirring, drops of sulfides in the top bubbled layer collide at a frequent rate and coalesce, attaining a size sufficient for dropping out from the top layer and rapidly sinking to the bottom.

The charge composed of a flotation concentrate or lump ore and flux with carbonaceous fuel or without it is fed from above or injected together with the gas in the top bubbled layer and uniformly distributed throughout said layer as it is stirred. The sulfides dissociate, melt and interact with the oxygen of the blast and the slag, this lowering the contents of magnetite and of useful components in the slag. Quartz and other hard-to-melt charge components dissolve rapidly under intensive stirring of the slag, an optimum slag composition being thus maintained throughout the body of the melt.

Fine droplets of sulfides remain for a long time in the stirred portion of the melt, thus ensuring a complete assimilation of oxygen and attainment of a specified desulfurization. The oxidation of sulfides is paralleled by a growth in the size of sulfide drops in the slag. Large sulfide melt drops have a greater sinking velocity and rapidly pass the layer of calm slag below the level of injection of the oxygen-bearing gas, collecting the fine sulfide inclusions they meet in their path and finally forming the bottom phase.

The slag is continuously run off the bottom part of the calm layer 4 of the slag. Because of this, the whole of the slag gradually moves from the top downwards, taking 2 to 4 h to travel the distance, and is as if washed by a shower of matte or crude metal drops formed in the top bubbled part of the melt, this organization of flow eliminates a rapid exit from the furnace of an untreated slag rich in nonferrous metals. Once separated from the sulfide phase or crude metal, the slag may be bubbled by a reducing gas in the presence of a solid reducing agent or a sulfidizing phase to volatilize zinc and other readily volatilizing components adn effect a deep denudation of the slag. The sulfide or the metallic bottom phase from the denudation of the slag may be discharged either together with the primary bottom phase or individually.

When the primary bottom phase is a rich matte or white matte, the sulfide melt 5 may be oxidized to crude metal or nickel-copper Bessemer matte out of contact with a waste slag low in useful components, this providing a high direct recovery of nonferrous metals and eliminating an enrichment of the slag in useful components.

If the converting of the sulfide melt 5 yields a slag, said slag is returned to the top bubbled layer of the heterogeneous melt 3 in liquid or solid form for denudation.

It is thus possible to completely separate in a single process the heavy nonferrous metal raw materials in to a crude metal, sulfur in the form of high-sulfur off gases, sublimates with a small amount of primary dust and a waste slag low in useful components.

The furnace for realizing the pyrometallurgical method for processing heavy nonferrous metal raw materials incorporates a shaft 6 equipped with side water-cooled tuyeres 7 arranged at a level dividing the shaft 6 into two vertical parts with a ratio of the top to the bottom partheights of 2-to-1 to 10-to-1, a device for discharging slag from the bottom part of the slag layer, termed a slag siphon, which is formed with a recipient 8 communicating with the internal cavity of the shaft 6 by means of a duct 9 arranged below the level of the tuyeres 7, but above a level 10 of the matte inside the shaft 6. This furnace design provides a sufficiently extended part of the shaft 6 below the level of the tueres 7 to create a zone of calm slag slowly moving downwards and thus ensure an effective separation of the slag from the matte and/or the crude metal drops and makes it possible to maintain constant the level of the melt inside the shaft 6 simultaneous with a continuous feeding of the charge and a continuous discharge of the slag. The top part of the shaft 6 terminates in a flue 11. The height of the top part of the shaft 6 upstream of the flue 11 should ensure a least entrainment of the melt by the ascending flow of gas. The middle part of the shaft 6 in the zone of the tuyeres 7 is formed with a jacketed section 12. The top part of the shaft 6 above the jacketed section 12 washed by the melt may be built either of cooled elements or of refractory materials.

A part of the shaft 6 below the tuyeres 7 is intended to provide conditions for separating a maximum proportion of the matte or the crude metal from the slag. The top of said part of the shaft 6 near the tuyeres 7 is part of the jacketed section 12, whereas the bottom part of the shaft and the hearth 13 are of refractory brick and are protected on the outside by add-on cooled plates (omitted on the figure) similarly to electrothermic furnaces. As jackets 14 of the jacketed section 12 are intensively heated in the hot stirred heterogeneous melt 3, they are designed as heavy parts from an adequately heat conductive material, e.g., copper, ensuring an effective extraction of heat. The ends of the tuyeres 7 projecting into the melt are to be cooled at a same intensity as the jackets 14 of the jacketed section 12.

An orifice 15 is provided in the top part of the shaft 6 or in the furnace roof for feeding the charge and the fuel, the charge being supplied, for example, with the aid of belt conveyors (omitted on the figure).

Figure 4:
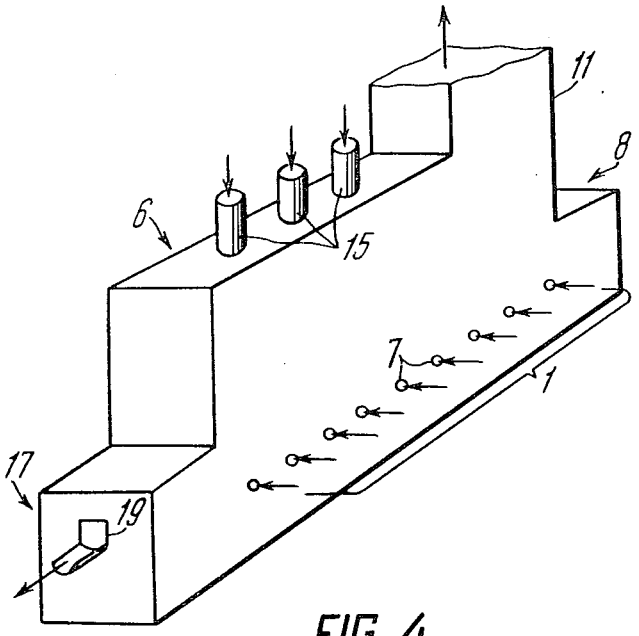
FIG. 4 is a schematic isometric projection of the furnace, according to the invention.

To make possible the injection of pulverized dry materials into shaft 6, the tuyeres 7 are provided with additional sleeves 16 through which said materials are, by pneumatic conveyance means, introduced into the melt, this minimizing dust entrainment. The roof of the duct 9 for removing slag from the shaft 6 and the walls of the external recipient 8 at the slag melt level 2 are built of the cooled jackets so as to avoid the dissolution of refractories in a running slag. The external recipient 8 has a port (not shown on the figure) with an adjustable level for discharging slag, this making it possible to adjust the level of the melt inside the shaft 6. The device for tapping the matte and/or the crude metal, termed the matte siphon, is the external recipient 17 from a refractory material communicating with the internal cavity of the shaft 6 through a duct 18 arranged below the level 10 of the matte inside the shaft 6. The external recipient 17 has a port 19 (FIG. 4) with an adjustable level for discharging the matte or the crude metal, this making possible the regulation of the level 10 of the matte or/and the crude metal inside the shaft 6. When the matte or the white matte from the shaft 6 is a high grate one, the external recipient 17 (FIG. 3) may be provided with a device 20 for supplying an oxygen-bearing gas to oxidize the matte to the crude metal. A wall of the recipient 17 has, at matte surface level, a port 21 for discharging a slag resulting from the converting. Gases from the converting of the matte in the recipient 17 are discharged into the flue 11 via a flue 22, combined with gases from the smelting and the oxidation processes and directed for a common recovery of all the sulfur charged in to the furnace as sulfides.

An external recipient 23 communicating with the internal cavity of the recipient 17 by means of a duct 24 arranged below the level 25 of the crude metal inside the shaft 6 is provided on the furnace to discharge the crude metal obtained through said converting.

To prevent solid crusts from freezing on the surface of melts in recipients for discharging liquid smelting products, the recipients 8, 17, 23 for discharging the melts from the shaft 6 may be equipped with a device for burning the fuel and thus heating (not shown on the figure) said recipients and melts.

When the slag is high in zinc and other components that tend to volatilize under reducing conditions, the shaft 6 is divided by a vertical partition 26 terminating below the level of the tuyeres 7, but above the level 10 of matte, said partition separating the internal cavity of the shaft 6 into a first chamber 27 and a second chamber 28, the charge being smelted and the smelting products being formed in the first chamber 27, and a resultant slag being reduced chemically and subjected to a denudation treatment to lower the content of useful components in the second chamber 28. The bottom part of the partition 26 should be of a cooled design to ensure a long service life in the intensively stirred heterogeneous melt 3. To induce a forced flow of slag from the bottom part of the first (smelting) chamber 27 into a top bubbled part 29 of the melt in the second (reducing) chamber 28, a second vertical partition 30 is installed in the bottom part of the second (reducing) chamber 28 in a manner that its one end is inside the melt above the level of the tuyeres 7 and the other end attains the level 10 of the matte.

There is provided in the top part of the second (reducing) chamber 28 or in the furnace roof an orifice 31 for charging lump reducing agent or sulfide materials for the denudation of the slag. Said materials may be conveyed to the charging orifice 31 with aid, for example, of a belt conveyor (omitted on the figure). The chambers 27 and 28 are provided with individual flues 11 and 32 to make possible separate utilizations of gaseous smelting products therefrom.

In an alternative embodiment, the chamber 28 for the reduction and the denudation of the slag may be equipped, instead of the side tuyeres 7, with burners for extraneous burning of a natural gas (omitted on the figure), this making it possible to inject hot gases into the melt with a least content of free oxygen and so enhance the effectiveness of the reduction process. The top part of the jacketed section 12 may be provided with orifices 33 for supplying an oxygen-bearing gas to burn the unused reducing gases and to oxidize the volatilized metals.

Smelting can be started in two ways. In a first procedure a hot liquid matte or slag is poured, via the recipient 8 or 17, level with the tuyeres 7 into the furnace which has been preheated to approximately 1150°-1200° C. by the devices for heating the siphons (not shown on the figure) and by injecting the fuel with an oxygen-bearing gas through the tuyeres 7. Charging is started once splashing conditions have been established inside the shaft 6 through the injection of an oxygen-bearing gas via the tuyeres 7. As slag and matte are smelted, respective melts in the recipients 8 and 17 attain discharge levels and start to flow continuously out of the furnace, this signifying the onset of stationary process conditions.

In absence of molten slag and matte, the furnace can be started up by melting solid only materials. It is then good practice to melt a bath level with the tuyeres 7 by using a solid matte or pure sulfide materials which are more readily melting. The heat for building up a bath is generated through combustion of the carbonaceous fuel fed together with the charge or injected through the tuyeres 7.

A fuller understanding of the nature and objects of the invention will be had from the following detailed examples thereof.

EXAMPLE 1

A copper sulfide charge for smelting in molten medium is composed of an ore in lumps up to 100 mm across, a flotation concentrate and a sandstone in lumps of up to 50 mm across said charge having a moisture content substantially equal to 7% and a following approximate chemical composition in terms of dry materials: copper, 20%, iron, 20%; sulfur, 22%; $SiO_2$, 17%; various other materials, 12%. Said charge is continuously fed into the shaft 6 of the furnace through the orifice 15 in amounts, for example, of 1600 t/24 h, or 66.6 t/h. The charge is transported to the charging orifice 15 by belt conveyors wheereon it is blended by discharging corresponding amounts of materials from bins equipped with weighing and batching (metering) devices (not shown on the drawing). The charge falls onto the top bubbled layer of the heterogeneous melt 3, heats up and melts therein. Because of an intensive stirring of the melt and high rates of dissolution of hard-to-melt charge components, of slag formation and of sulfide oxidation, the efficiency of the furnace for smelting in a molten medium amounts to approximately 80 t/m$^2$.24 h for a horizontal section of the shaft 6 in the tuyere 7 zone measuring 2.5×8 m. With the shaft 6 being roughly 7 m high, the furnace efficiency per unit volume approximates 11 t/m$^3$ .24 h. To oxidize the sulfides and heat the melt to 1350° C. and obtain a 50% copper grade matte, an air-oxygen mixture with about 60% oxygen and a natural gas are injected into the melt through the tueyres 7. In accordance with the material and the heat balances, there are supplied into the furnace shaft 6 through the tuyeres 7 2100 m$^3$ STP/h natural gas at a pressure of 1.3 atm, 10,500 m$^3$ STP/h commercial oxygen and 10,900 m$^3$ STP/h air at a pressure of 1.0 atm. Said mixture is injected through the tuyeres 7 at a velocity substantially close to 230 m/s. Because of the dissociation of higher sulfides throughout the stirred layer of the heterogeneous melt 3, iron sulfide not only passes over to the matte, but also dissolves in the slag. Oxygen reacts with iron sulfide of the matte and the slag according to reactions:

$$[FeS]+1.5\ O_2 \rightarrow (FeO)+SO_2,$$

$$(FeS)+1.5\ O_2 \rightarrow [FeO]+SO_2,$$

and with iron oxide in the slag $$3\ (FeO)+0.5\ O_2 \rightarrow (Fe_3O_4)$$

Because of a high concentration of sulfur and its high activity, there is practically no oxidation of copper sulfides in the slag. A factor contributing to this is also the evolution of sulfur on interaction of magnetite with iron
sulfide according to reactions:

$$2\ (Fe_3O_4)+2\ [FeS] \rightarrow 8\ (FeO)+S_2$$

$$3\ (Fe\ O)+[FeS] \rightarrow 10\ (FeO)+SO_2$$

Drops of molten matte coalesce, fall out of the bubbled heterogeneous melt, pass the layer of calm slag 4 and form the matte 5 of the bottom layer. As said layer communicates via the duct 18 with the recipient 17 filled with matte to discharge level, the formation of an additional amount of matte leads to the discharge from the shaft of a corresponding quantity of matte, roughly 26.5 t/h, at a temperature of about 1200° C.

As the slag builds up in the layer of the heterogeneous melt 3 inside the shaft 6 and its level rises, a corresponding amount of the slag flows from the bottom part of the calm layer 4 of the slag along the duct 9 into the cavity 8 and is continuously discharged from the slag siphon as its level 2 in the recipient 8 rises above that set for the discharge of the slag. Thus, there are maintained inside the furnace stationary conditions which contribute to the formation of the slag with 32% $SiO_2$, 5% (not more) $Fe_3O_4$ and 0.4% Cu in amounts of 640 t in 24 h or 26.7 t/h at a temperature between 1250° and 1300° C.

Resultant gases in amounts of about 18,000 m$^3$ STP/h, having a temperature of about 1300° C. and containing apparoximately 40% $SO_2$, are exhausted from the furnace shaft 6 via the flue 11, the quantity of dust and melt splashes entrained with said gases averaging 1% by weight of the charge. The recovery of copper to the matte approximates 98.5%.

The temperature of the melt can be regulated by varying the quantity of the injected natural gas or the content of oxygen in the oxygen-bearing gas while retaining intact its overall amount to stabilize bott the composition of the matte and the desulfurization.

EXAMPLE 2

A charge in amounts of about 1200 t in 24 h or 50 t/h with a moisture content of 6% and composed of 1000 t copper-zinc concentrate running 19% copper, 30% iron, 5.5% zinc, 36.7% sulfur, and 200 t of quartz flux containing 70% $SiO_2$ is fed through the orifice 15 into the smelting chamber 27 of the shaft 6 with a hearth surface are of 20 $m^2$.

An oxygen-bearing gas with 90% oxygen is blown through the tuyeres 7 in the heterogeneous bubbled melt 3 in amounts of 12,000 $m^3$ STP/h. There is then formed in the smelting chamber 27 a matte with about 75% copper, whereas the quantity of the generated heat is quite sufficient for the autogeneous smelting of the charge. The matte flows along the duct 18 into the recipient 17 where it is oxidized with the aid of the device 20, which injects an oxygen-bearing gas at a pressure of 5 atm, to blister copper 34 which settles to the bottom, flows to the recipient 23 via the duct 24 and is discharged from the furnace. The slag resulting from the oxidation of the matte is discharged from the recipient 17 through the port 21 and is returned as a solid charge component into the bubbled layer 3 of the heterogeneous melt through the orifice 15. A sulfurous gas from the oxidation of the matte in the recipient 17 is channeled via the flue 22 into the common flue 11 of oxidizing gases. The slag of the smelting chamber 27, containing 10% zinc, 28% $SiO_2$ and 1% copper, flows between the partitions 26 and 30 into the bubbled layer 29 of the chamber 28 for reduction and denudation of slag. An oxygen-bearing gas 1 with 90% oxygen and a pulverized coal are injected inside the chamber 28 of the shaft 6 through the tuyeres 7 with the aid of the charging sleeve 16 in amounts of respectively of 3500 $m^3$ STP/h and 90 t/24 h or 3.5 t/h.

Copper reduced from the slag sinks in drops to the bottom phase, whereas zinc is reduced and volatilized by 90% into the gas phase. An oxygen-bearing gas with 35% oxygen is injected into the top part of the chamber 28 through the orifice 33 in amounts of 3000 $m^3$ STP/h to oxidize CO and Zn to respectively $CO_2$ and ZnO. Zinc oxide is collected as dust with 65% zinc.

The slag from the chamber 28 containing 0.3% copper, 1.7% zinc and 33% $SiO_2$ flows via the recipient 8 and is discharged into slag ladle cars for transportation to waste dump (not shown on the figure).

Thus, the above method makes it possible to process in a single apparatus a copper-zinc material with a recovery of copper of 98.5% to blister copper, of sulfur of 95% into high-grade off gases and of zinc of 90% to sublimates.

EXAMPLE 3

A nickel sulfide charge with a moisture content of 6%, which is composed of a nickel concentrate and a quartz flux and running 9% nickel, 34% iron, 32% sulfur, 14% $SiO_2$, 11% miscellaneous other components, is fed continuously through the orifice 15 into the heterogeneous bubbled melt 3 in amounts of approximately 1300 t/24 h or 54 t/h. Together with the charge are also fed 2 t/h of coal in lumps measuring up to 100 mm. An oxygen-bearing gas with 70% oxygen is injected into the melt through the tuyeres 7.

The reaction of oxygen with sulfides and coal in the melt maintains a temperature of about 1350° C. and results in the formation of a nickel Bessemer matte at a recovery of nickel into the Bessemer matte of 97%, said matte being tapped from the furnace through the recipient 17 and transferred together with cobalt it carries (cobalt recovery to said matte amounting to 75%) to a subsequent process operation for separate extractions of nickel and cobalt. The slag containing 36% $SiO_2$ and 0.2% nickel is discharged from the slag siphon and dumped. The gases with 85% of the starting amount of sulfur are directed to plants for production of sulfuric acid.

EXAMPLE 4

A sulfide lead concentrate containing 56.6% lead, 4.06% zinc, 0.65% copper, 6.97% iron, 12.56% sulfur and 6% moisture is continuously fed through the orifice 15 in the top part of the shaft 6 into the smelting chamber 27, measuring 2.5×8 m in horizontal section, at the rate of approximately 1000 t/24 h together with 13.0 t limestone (53% CaO) and 80 t coal. Some 12,000 $m^3$ STP/h of a mixture of commercial oxygen and air containing 70% oxygen are blown into the heterogeneous melt 3 through the tuyeres 7. In the bubbled heterogeneous melt 3, the slag is maintained at a temperature of 1200° to 1220° C.

Oxidation of sulfides and interaction of lead sulfide with lead oxide leads to a crude lead, running 96% lead and 0.9% copper, which accumulates on the hearth 13. The slag 4 of the smelting chamber 27, containing 11.5% lead, 11% zinc, 20% iron, 15% $SiO_2$ and 6% CaO, flows between the partitions 26 and 30 into the chamber 28 for the reduction and the denudation of slag. The off gases of the smelting chamber 27 contain 22% $CO_2$, 21% CO, 27% $SO_2$ and have a temperature of about 1200° C. After cleaning of dust and cooling, the gases are directed to plants for production of sulfuric acid.

The chamber 28 for the reduction and the denudation of slag, measuring 2.5×5 m in horizontal section, is continuously charged through the orifice 31 with 80 t/24 h of coal, wheareas 3100 $m^3$ STP/h of a mixture of commercial oxygen with air running 70% oxygen are blown through the tuyeres 7. As a result of the interaction of oxygen with coal and of coal and reducing gases (22% $CO_2$, 56% CO) with the slag, lead of the slag is reduced to metal and passes to the bottom phase, whereas zinc is volatilzed by 90%, oxidized in the gas phase to oxide and collected as dust containing about 70% ZnO.

From the chamber 28 for the reduction and the denudation of the slag, there are continuously discharged, through the slag siphon, some 260 t/24 h of waste slag, containing 1% lead, 1.7% zinc, 0.2% copper, 20% $SiO_2$, 8% CaO, 33% FeO, at a temperature of 1200° to 1250° C.

The crude lead at a temperature of about 1050° C. is also continuously tapped through the recipient 23 for the crude metal. The recovery of lead from the charge to the crude metal amounts to 98%.

It is readily apparent from the above data, that there is suggested a radically novel method for processing heavy nonferrous metal raw materials, or smelting in molten medium, presenting a number of substantial advantages as compared to other techniques. The efficiency of the suggested method is 5 to 7 times greater than that of known processes, the content of copper in the matte attaining 70 to 75%, with that in the slag being not higher than 0.4–0.7%, this being substantially better than respective data of alternative known techniques. The proposed method and furnace make it possible to obtain crude metals by a single-stage process and drive off volatile components into the gas phase.

Along with simpler and fulle recovery of nonferrous metals, the present purometallurgical method and furnace for processing heavy nonferrous metal raw materials make it possible to greatly simplify the pre-smelting preparation of raw materials, to dispense with drying to low moisture content and crushing, this being a substantial advantage when considered against the background of a large tonnage processing of loose materials. A substantial enrichment of blast in oxygen leads to either autogeneous smelting or to a sharp drop in the consumption of the carbonaceous fuel and to gases with a high sulfur content directed to sulfuric acid production plants where sulfur is completely recovered at an excellent economic effectiveness, this greatly minimizing pollution of the environment by metallurgical production waste.

Approximate economic calculations tend to indicate that the industrial introduction of the above method will provide a sizable economy because of the above advantages over existing techniques.

What is claimed is:

1. A pyrometallurgical method for processing heavy nonferrous metal raw materials comprising the steps of:

(a) providing a heavy nonferrous metal raw material;

(b) melting the raw material to produce a heterogeneous melt;

(c) injecting a gas containing at least 30% oxygen into the melt at a rate of from about 200 to about 2000 $m^3$ STP/h per square meter of a horizontal section of the melt, whereby the melt is divided into a top bubbled layer and a calm bottom layer, said calm bottom layer comprising a slag layer and a matte layer;

(d) feeding a charge comprising the heavy nonferrous metal raw material into the top bubbled layer of the heterogeneous melt, whereby the components of the charge are heated, melted and interact with both the melt and the oxygen-containing gas to form drops of a matte, which because of the bubbling, collide, coalesce and fall from the top layer into the calm bottom layer, passing through the slag and accumulating as a matte layer; and (e) separately discharging the matte and the slag from the bottom portions of their respective layers.

2. The method of claim 1, wherein the calm bottom layer is composed of a slag layer, a matte layer and a crude metal layer.

3. The method of claim 1, wherein a carbonaceous fuel is injected into the top bubbled layer of the heterogeneous melt.

4. The method of claim 3, wherein the carbonaceous fuel is natural gas.

5. The method of claim 3, wherein the carbonaceous fuel is a liquid.

6. The method of claim 3, wherein the carbonaceous fuel is pulverized coal.

7. The method of claim 3, wherein the carbonaceous fuel is lump coal.

8. The method of claim 3, wherein the carbonaceous fuel is lump coke.

9. The method of claim 1 further comprising the steps of separating the matte from the heterogeneous melt and continuously oxidizing the matte to a crude metal.

10. The method of claim 9, wherein slag resulting from the oxidation of the matte is added to the top bubbled layer of the heterogeneous melt.

11. The method of claim 1, further comprising the steps of separating the slag from the heterogeneous melt and bubbling a gas thereinto under reducing conditions driving off any volatile components and denuding the slag with respect to useful components.

12. The method of claim 11, wherein the reducing conditions are created by the addition of a solid reducing agent.

13. The method of claim 11 further comprising the step of adding a sulfide extracting phase to the slag.

* * * * *